US006684858B2

(12) United States Patent
Sato et al.

(10) Patent No.: US 6,684,858 B2
(45) Date of Patent: Feb. 3, 2004

(54) FUEL SUPPLY SYSTEM OF A V-TYPE ENGINE

(75) Inventors: Eiichi Sato, Kanagawa (JP); Seiji Ishihara, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 307 days.

(21) Appl. No.: 09/964,672

(22) Filed: Sep. 28, 2001

(65) Prior Publication Data

US 2002/0038651 A1 Apr. 4, 2002

(30) Foreign Application Priority Data

Oct. 3, 2000 (JP) ..... 2000-303425

(51) Int. Cl.[7] ..... F02M 55/02
(52) U.S. Cl. ..... 123/468; 123/469; 123/456
(58) Field of Search ..... 123/456, 541, 123/468, 469, 470, 494, 41, 31, 198 D

(56) References Cited

U.S. PATENT DOCUMENTS 4,346,676 A * 8/1982 Tyner ..... 123/41.74
5,197,436 A * 3/1993 Ozawa ..... 123/456
5,309,885 A * 5/1994 Rawlings et al. ..... 123/509
5,943,994 A * 8/1999 Hosoi et al. ..... 123/468
6,237,547 B1 * 5/2001 Ishiyama ..... 123/41.31
6,250,290 B1 * 6/2001 Mullen ..... 123/541
6,340,019 B1 * 1/2002 Eshleman et al. ..... 123/469
6,367,451 B2 * 4/2002 Kato ..... 123/456
6,446,585 B1 * 9/2002 Coffey et al. ..... 123/41.1
6,460,511 B2 * 10/2002 Kato ..... 123/468

FOREIGN PATENT DOCUMENTS

JP 08-334032 * 12/1996

* cited by examiner

*Primary Examiner*—Carl S. Miller
(74) *Attorney, Agent, or Firm*—Foley & Lardner

(57) ABSTRACT

A support structure for a fuel supply system of a V-type engine having a mechanical connection to fixedly connect an intermediate portion of a fuel supply conduit portion arranged to straddle between the cylinder heads in two banks of the V-type engine to a water jacket assembly disposed to bridge between and rigidly connected to the cylinder heads to thereby provide a rigid vibration-suppressing support for the fuel supply conduit portion of the fuel supply system whereby generation of the working sound of respective fuel injection valves in every cylinders of the V-type engine is suppressed and reduced.

9 Claims, 3 Drawing Sheets

FUEL SUPPLY SYSTEM OF A V-TYPE ENGINE

BACKGROUND OF THE INVENTION

The present invention relates to a technical art for suppressing and reducing sound that is generated by a fuel supply system of a V-type engine.

BACKGROUND INFORMATION

In the fuel supply system of a V-type engine, fuel under pressure supplied by a fuel pump is subjected to a controlling in pressure by a pressure regulating valve, and is supplied to a fuel supply conduit having a portion thereof arranged to straddle between the cylinder heads disposed in the two V-like banks of the V-type engine. The fuel is further distributed from the fuel supply conduit to fuel-injection valves provided for the respective cylinders of the V-type engine, via respective fuel distribution conduits provided for the cylinders in the two banks; of the V-type engine. The above-described arrangement of the fuel supply system of the V-type engine is disclosed in the Laid-open Japanese Patent Publication No. 8-334032.

In the disclosed prior art fuel supply system of the V-type engine, the portion of the fuel supply conduit that is arranged to straddle between the cylinder heads of the two banks is supported at its opposite ends only, and accordingly the mechanical rigidity in supporting that portion of the fuel supply conduit is small. Thus, while the fuel injection valves are operating, the less rigid fuel supply conduit portion often becomes a sound source generating a large working sound of the fuel injection valves, which includes a sound component due to the driving of the fuel injection valves and a vibratory sound component due to a change in the pressure of the fuel that occurs during the injection of the fuel toward the respective cylinders of the V-type engine. In particular, in the direct-injection type engine, which has recently become the majority in the V-type engines, the fuel injection must be done under a high pressure, and accordingly the fuel is pressurized to have a rather high pressure by a high-pressure type fuel pump before it is supplied to the respective fuel injection valves. Consequently, the working sound that is generated by the fuel injection valves in operation has become an unignorable problem requested to solve.

SUMMARY OF THE INVENTION

Therefore, an object of the present invention is to solve the problem encountered by the fuel supply system of the V-type engine according to the prior art.

Another object of the present invention is to provide a high rigidity support structure for a fuel supply conduit of a fuel supply system, specifically a fuel supply conduit portion of the fuel supply conduit, which is arranged to straddle between the cylinder heads of both banks of a V-type engine, so that the working sound of the fuel injection valves generated by and transmitted from the fuel supply conduit portion may be satisfactorily suppressed and reduced.

Taking into account the above objects, according to the present invention, there is provided a support structure for a fuel supply conduit portion of a fuel supply conduit that is arranged to straddle between the cylinder heads of both banks of the V-type engine, the support structure being constituted by a mechanical connection that connects a generally intermediate portion of the fuel supply conduit portion to a water jacket member extending to bridge between the cylinder heads of both banks of the V-type engine and rigidly fixed at its opposite ends to the cylinder heads. Thus, the support structure for the fuel supply conduit portion straddling between the cylinder heads of both banks of the V-type engine can provide the same bridge-conduit portion with a highly rigid support due to the mechanical connection provided between the fuel supply conduit portion and the water jacket member, so that any vibratory motion which might occur in the fuel supply conduit portion straddling between the cylinder heads of both banks of the V-type engine can be prevented. As a result, the working sound of the fuel injection valves that is generated by the fuel supply conduit portion can be suppressed and reduced. Particularly, since the fuel supply conduit portion of the fuel supply system is eventually connected to the engine body at a position adjacent to the center of vibration of the engine, the fuel supply conduit portion of the fuel supply system supported by the support structure is not permitted to cause any resonant vibration with the engine vibration. Therefore, the generation of the working sound of the fuel injection valves by the fuel supply conduit portion of the fuel supply system of the V-type engine can be effectively suppressed and reduced.

The above and other objects, features and advantages of the present invention will be made more apparent from the ensuing description of the following description of a preferred embodiment thereof with reference to the accompanying drawings.

DESCRIPTION OF A PREFERRED EMBODIMENT

Figure 1:
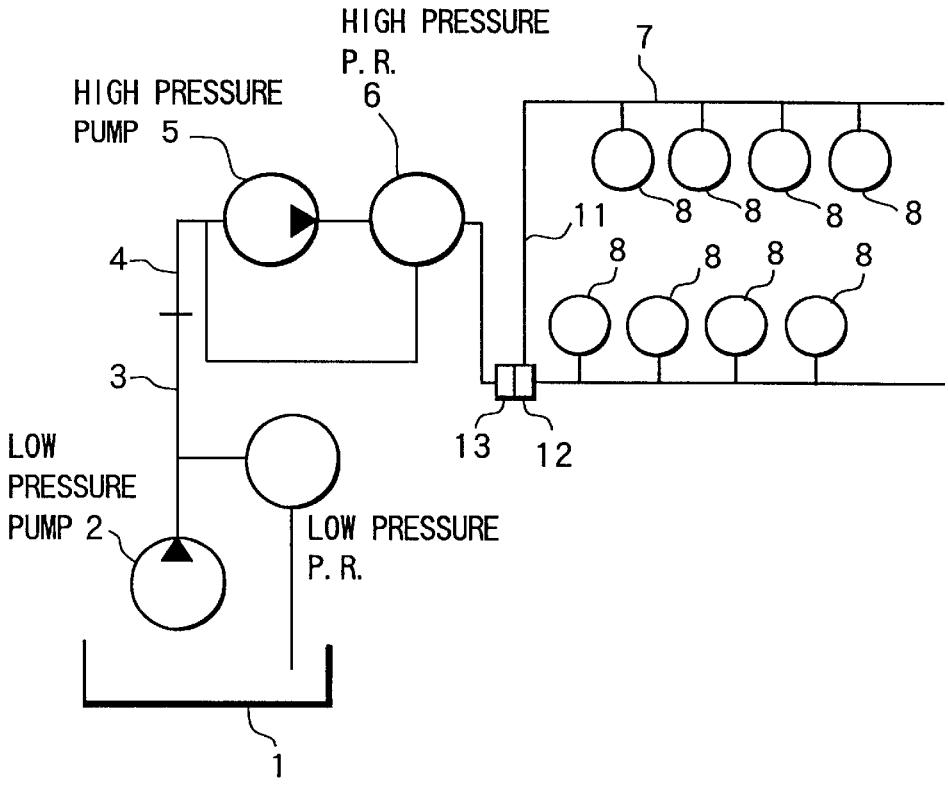
FIG. 1 is a schematic diagram illustrating a fuel supply system of a V-type (V-8) internal combustion engine to which the present invention is applied.

Referring first to FIG. 1, which illustrates a fuel supply system of a V-type engine on which a sound-reducing support structure according to the present invention is mounted, the fuel is stored in a fuel tank 1, and is pumped out by a low-pressure pump 2 to be delivered to a fuel supply conduit 3 arranged underneath a vehicle body (not shown in FIG. 1). The fuel is further supplied under pressure to a high-pressure pump 5, via a fuel hose 4 arranged in a vehicle engine compartment. The fuel is pressurized by the high-pressure pump 5 and is delivered to a fuel supply conduit 7 usually referred to as a delivery pipe via a pressure regulator 6. The fuel supply conduit 7 is constituted by a plurality of conduit members connected in series, and thus the fuel supply conduit 7 is provided with a plurality of connecting portions that are used to be connected to fuel injection valves 8 the number of which depends on the number of cylinders of the V-type engine. The illustrated example, eight fuel injection valves 8 are arranged for the V-8 engine. The respective injection valves 8 are arranged so that the injection nozzles thereof are exposed toward respective combustion chambers of the V-8 engine cylinders. The fuel in the fuel supply conduit 7 is directly injected into the respective cylinders of the V-type (V-8) engine when the fuel injection valves 8 are operated.

Each of the fuel injection valves 8 includes therein an electro-magnetically operated needle valve (not shown in FIG. 1), the movement of which is controlled by an electronic controlling unit (not shown in FIG. 1). More specifically, when the electronic controlling unit delivers an injection command in the form of a pulse width injection signal to a drive unit for each of the fuel injection valves 8, the drive unit drives the corresponding needle valve of each fuel injection valve 8. Thus, the injection port of each of the fuel injection valves 8 is opened the time duration of which is in proportion to the pulse width of the pulse width injection signal, and accordingly the injection amount of the fuel toward the respective cylinders of the V-type engine is in proportion to the pulse width injection signal.

As clearly shown in FIG. 1, the fuel supply conduit 7 has an intermediate conduit portion 11 thereof, which is referred to as a fuel supply conduit portion 11 throughout this application. The fuel supply conduit portion 11 of the fuel supply conduit 7 is arranged to straddle between the cylinder heads of the V-type engine, which are disposed in two V-like banks set at a given angle. The fuel delivery bridge-conduit portion 11 is supported by a later-described rigid support structure according to the present invention so that generation of the working sound of the fuel injection valves 8 by the fuel supply conduit portion 11 may be effectively suppressed and reduced during the operation of the valves 8.

Figure 2:
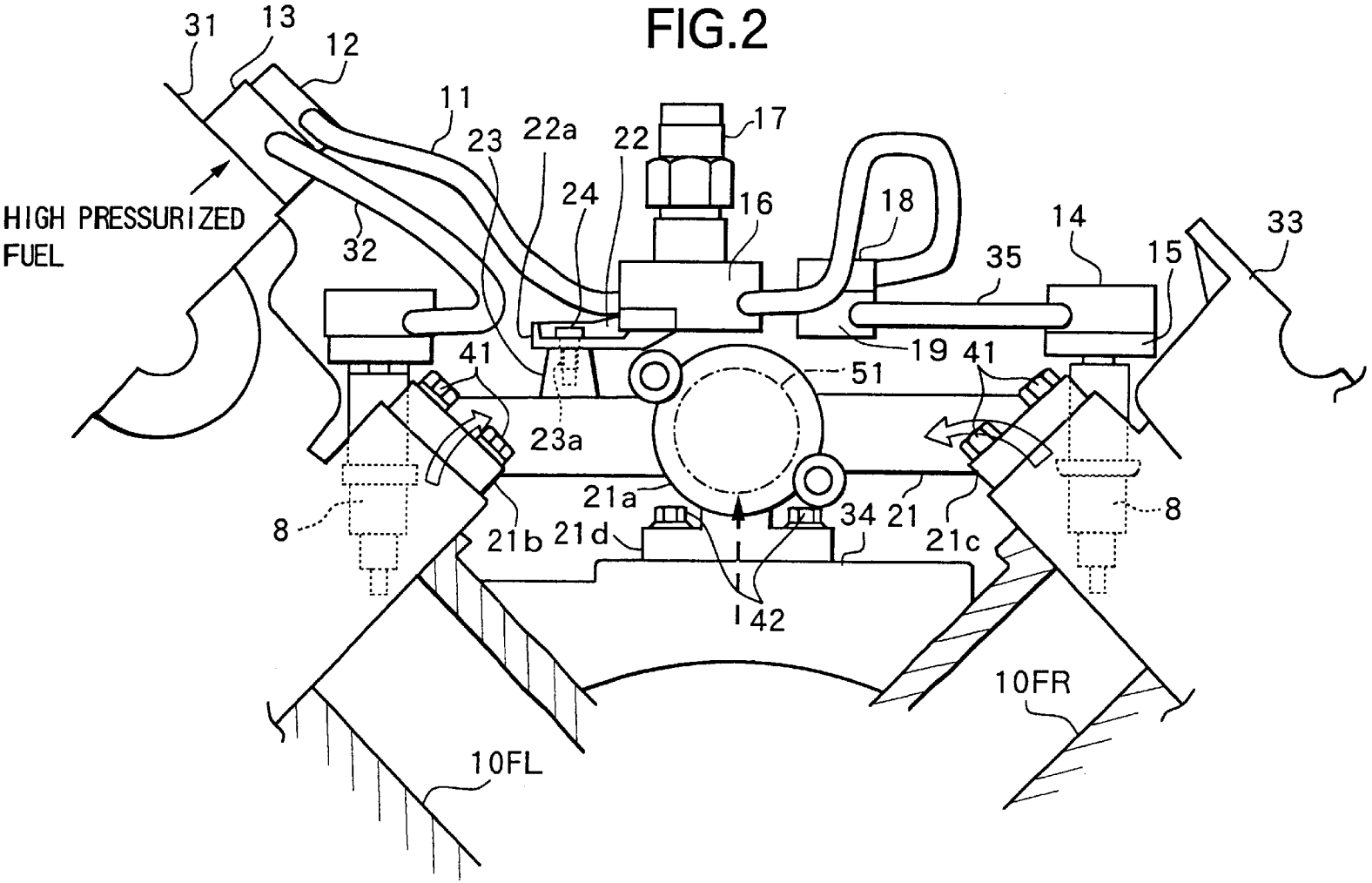
FIG. 2 is a schematic longitudinal-sectional view of the V-type engine, illustrating the support structure for the fuel supply conduit portion of the fuel supply conduit of the fuel supply system, according to a preferred embodiment of the present invention.
Figure 3:
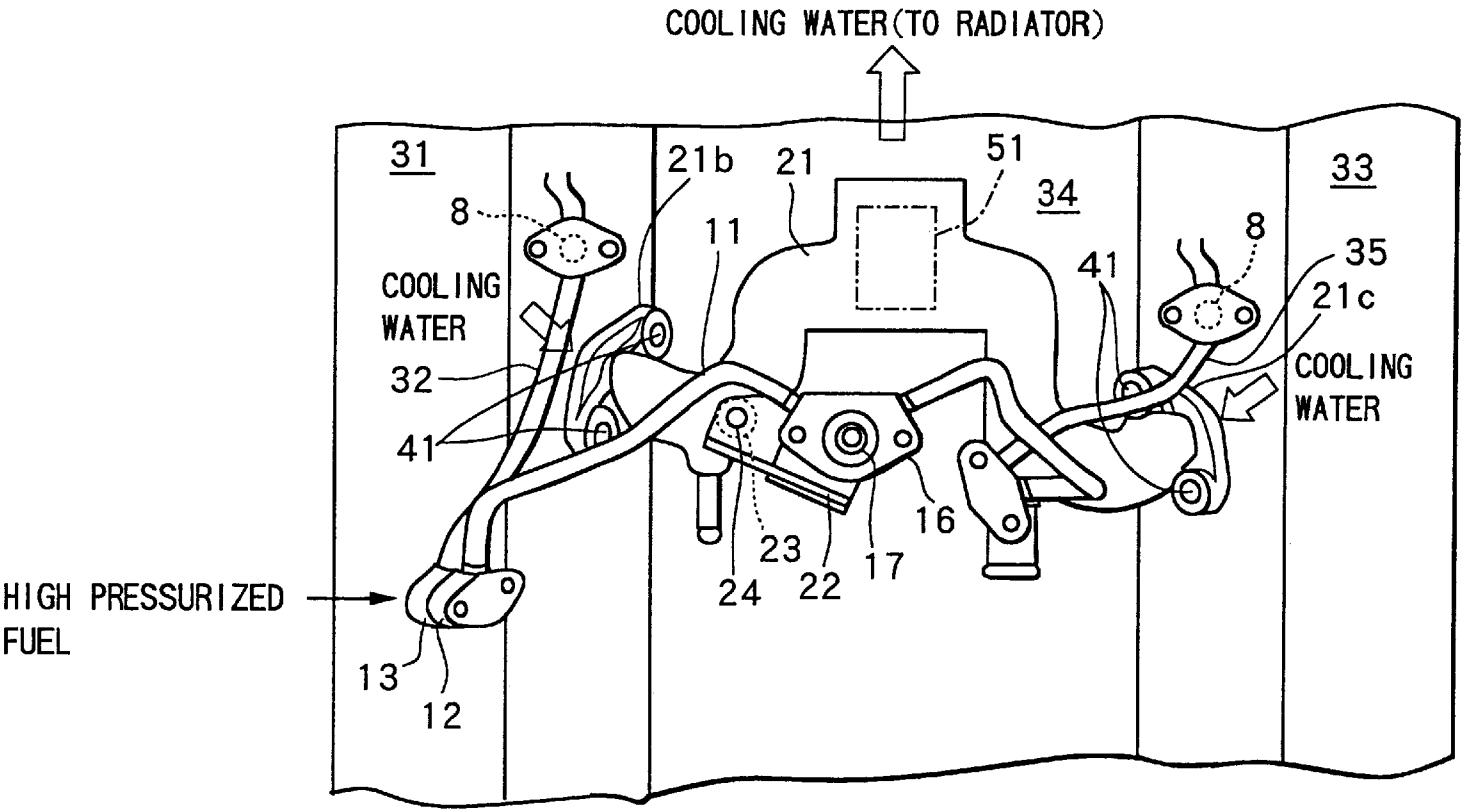
FIG. 3 is a plan view showing an essential part of the support structure for the fuel supply conduit portion of the fuel supply conduit of the fuel supply system, according to the embodiment.

FIGS. 2 and 3 each illustrates the support structure for the above-mentioned fuel supply conduit portion 11 arranged to straddle between the cylinder heads of the banks of the V-type engine.

As clearly shown in FIG. 2, the fuel supply conduit portion 11 has one end portion, which extends to a summit end of a cylinder head 31 of the left side bank of the V-type engine, to be fluidly connected to one end portion of a fuel distribution conduit 32 that is connected to the fuel injection valve 8 for a cylinder 10FL located at a front end side of the left side bank, via two connecting brackets 12 and 13 arranged to superimpose one on the other. More specifically, since the two superimposed connecting brackets 12 and 13 are provided therein with an internal chamber, respectively, defining a fluidly connected fuel chamber, the fuel delivered from the high-pressure pump 5 and then adjusted to a high-pressure by the high-pressure regulator 6 is distributed from the brackets 12 and 13 toward the fuel injection valve 8 provided on the left side bank, via the fuel distribution conduit 32. At the same time, the fuel supply conduit portion 11 is connected to the bracket 12 and supplied with a high-pressure fuel delivered through the high-pressure regulator 6 via the fuel chamber within the connecting brackets 12 and 13. The high pressure value of the fuel is preferably set so that when the fuel delivered to the respective fuel injection valves 8, each valve 8 injects the fuel into the combustion chamber of the corresponding cylinder during the compression stroke of the V-type engine.

The other end portion of the fuel supply conduit portion 11 extends to a cylinder head 33 in the right side bank of the V-type engine, to be fluidly connected to a fuel inlet formed in the head of the fuel injection valve 8 for a cylinder 10FR located at a front end portion of the right side bank, via connecting brackets 18 and 19, a fuel distribution conduit 35, and connecting brackets 14 and 15.

The fuel supply conduit portion 11 is provided, at its intermediate portion, with a mounting bracket 16 on which a fuel pressure sensor 17 is mounted. The mounting bracket 16 is formed therein with a fuel passage forming a part of the fuel supply conduit portion 11 and having a fuel inlet and a fuel outlet. Thus, the fuel outlet of the mounting bracket 16 is fluidly connected to the fuel inlet of the afore-mentioned connecting bracket 14 via a part of the fuel supply conduit portion 11 and a pair of connecting brackets 18 and 19, which are arranged to superimpose one on the other. In the present embodiment, the afore-mentioned connecting bracket 12 on the left side bank, the mounting bracket 16 including a later-described fastening bracket 24, the connecting bracket 18, and two portions of the fuel supply conduit portion that extend between the two brackets 12 and 16 and between the two brackets 16 and 18 are formed as a unit of sub-assembly which is preliminarily assembled before it is mounted on the V-type engine.

On the other hand, a tubular water jacket assembly 21 is provided under the fuel supply conduit portion 11. The tubular water jacket assembly 21 is arranged so as to bridge the left and right side cylinder heads 31 and 33, and is provided with a cylindrical chamber 21*a* formed in an intermediate portion of the tubular water jacket assembly 21. The tubular water jacket assembly 21 is further provided with a vertical jacket portion branching from the cylindrical chamber 21*a* and extending downward to a later-described cylinder block 34 via a flange member 21*d*. The tubular water jacket assembly 21 is formed therein with a fluid passage permitting an engine cooling water to flow therethrough. The tubular water jacket assembly 21 is provided with opposite ends thereof, which are connected to the walls of the left and right side cylinder heads 31 and 33, via flange members 21*b* and 21*c*. Namely, the flange members 21*b* and 21*c* of the tubular water jacket assembly 21 are tightly connected to the left and right side cylinder heads 31 and 33 by means of screw bolts 41. Furthermore, the flange member 21*d* of the vertical jacket portion of the water jacket assembly 21 is tightly connected, by means of screw bolts 42, to the summit of the cylinder block 34 that is provided between the left and right side cylinder heads 31 and 33. Thus, the tubular water jacket 21 is rigidly connected to and supported by the cylinder block 34, i.e., the body of the V-type engine.

At this stage, as shown by an arrow, the engine cooling water cools the two cylinder heads 31 and 33 form the front side of the V-type engine body and flowing into the tubular water jacket assembly 21 from the left and right side ends thereof, and returns to the front side of the engine body and in turn to a cooling radiator, via a thermostat 51 disposed in the afore-mentioned cylindrical chamber 21*a*. While the engine is being in a hot condition, as shown by an arrow in dotted line, the thermostat 51 of the cylindrical chamber 21*a* is set at an open condition, so that a part of the flow of the engine cooling water coming from the cylinder block 34 via the vertical jacket portion of the tubular water jacket assembly 21 joins the flow of the engine cooling water coming from the cylinder heads 31 and 33 at the position of the opened thermostat, and the joined flow of the engine cooling water returns to the front side of the engine body. On the contrary, while the engine is being in a cold condition, the above-mentioned thermostat 51 in the cylindrical chamber 21*a* is closed to block the flow of the engine cooling water coming from the cylinder block 34. Therefore, the engine cooling water pumped by a water-pump (not shown in FIG. 2) flows toward the cylinder heads 31 and 33 to cool only these cylinder heads.

Now, the description of the support structure for the fuel supply conduit portion 11 will be provided below.

The fuel supply conduit portion 11 arranged to straddle between the left and right side cylinder heads 31 and 33 is mechanically supported by a support structure which is constituted by a rigid connection provided between an intermediate portion of the fuel supply conduit portion 11 and the above-mentioned tubular water jacket assembly 21 that is rigidly connected to the engine body. More specifically, the afore-mentioned mounting bracket 16 on which the fuel pressure sensor 17 is mounted is provided, at its lower side, a connecting bracket 22, which is welded to the lower side of the connecting bracket 16. Namely, the connecting bracket 22 is integral with the mounting bracket 16. On the other hand, a connecting boss member 23 extending upward is welded, at its lower end, to the tubular water jacket assembly 21. The connecting boss 23 is arranged so that an upper end thereof is in approximately registry with an end portion of the connecting bracket 22 rigidly connected to the mounting bracket 16 of the fuel supply conduit portion 11. Further, the end portion of the mounting bracket 16 is formed with a through-hole 22*a* through which a connecting screw bolt 24 is inserted to be threadedly engaged in a screw hole 23*a* formed in the connecting boss 23. Therefore, a rigid connection is provided between the fuel supply conduit portion 11 and the tubular water jacket assembly 21. Accordingly, the fuel supply conduit portion 11 is rigidly supported by the engine body via the tubular water jacket assembly 21. In other wards, since the fuel supply conduit portion 11 straddling between the left and right side cylinder heads 31 and 33 is rigidly connected, at its intermediate portion, to the tubular water jacket assembly 21 that is rigidly connected to the engine body, the rigidity in supporting the fuel supply conduit portion 11 can be high enough for enabling it to effectively suppress and reduce generation of the working sound of the fuel injection valves 8 by the fuel supply conduit portion 11 of the fuel supply system of the V-type engine. At this stage, since the connection of the fuel supply conduit portion 11 and the tubular water jacket assembly 21 by the use of the connecting bracket 22, the connecting boss 23 and the threaded engagement of the screw bolt 24 and threaded hole 23*a* is provided at a preselected position adjacent to the center of vibration of the V-type engine, the engine vibration does not provide any adverse affect on the rigid connection between the fuel supply conduit portion 11 and the engine body per se via the water jacket assembly 21. Thus, the sound reduction effect by the support structure for the fuel supply conduit portion can be very high.

Further, as will be well understood from the foregoing description with reference to FIG. 2, since the intermediate portion of the fuel supply conduit portion 11 is connected to the water jacket assembly 21 via the mounting bracket 16 on which the fuel-pressure sensor 17 that can function as a mass body member having a predetermined or more amount of mass, the resonant frequency of the fuel supply conduit portion 11 is kept at a relatively low frequency region. This fact is very effective for reducing the sound generation of the working sound of the fuel injection valves 8. Namely, since the working sound of the fuel injection valves 8 has a relatively high frequency, the fuel supply conduit portion 11 has no resonant frequency with the frequency of the fuel injection valves 8. As a result, the sound reduction effect can be enhanced. Namely, the use of the fuel-pressure sensor 17 functioning as a mass body member contributes to deletion of the employment of any particular mass body member for reducing the sound generation by the fuel supply conduit portion 11, and therefore, a cost reduction effect can be additionally achieved.

Although the present invention is effective for reducing the sound generation of the fuel injection valves accommodated in the V-type direct-injection internal combustion engines, it should be appreciated that the present invention can be also applicable to a sound reduction arrangement for a V-type engine in which fuel injection by the fuel injection valves is performed into intake ports of the engine.

This application claims priority to Japanese Patent Application No. 2000-303425 filed on Oct. 3, 2000, and accordingly the entire disclosure of the Japanese Patent Application No. 2000-303425 is hereby incorporated herein by reference.

Although only one selected embodiment has been chosen to describe and illustrate the present invention, it will be apparent to those skilled in the art from this disclosure that various changes and modifications can be made without departing from the scope of the invention as defined in the appended claims.

What is claimed is:

1. A fuel supply system for a V-type engine, comprising:

a fuel pump;

a fuel injection valve provided for each cylinder of the V-type engine;

a fuel supply conduit that delivers fuel supplied from the fuel pump to the each fuel injection valve;

a water jacket assembly arranged to bridge between respective cylinder heads in both banks of the V-type engine, to be rigidly connected to the respective cylinder heads; and a fixing member that fixes an intermediate portion of the fuel supply conduit straddling between the respective cylinder heads in both banks of the V-type engine to the water jacket assembly.

2. The fuel supply system as set forth in claim 1, wherein the fixing member fixes the intermediate portion of the fuel supply conduit via a mass body member to the water jacket assembly.

3. The fuel supply system as set forth in claim 2, wherein the mass body member comprises a fuel-pressure sensor.

4. The fuel supply system as set forth in claim 3, wherein the fixing member comprises:

a mounting bracket that mounts the mass body member to the fuel supply conduit;

a connecting bracket fixed to the mounting bracket;

a boss formed on the water jacket assembly; and a bolt that joints the connecting bracket and the boss.

5. The fuel supply system as set forth in claim 1, wherein the water jacket assembly is provided with a central portion thereof rigidly connected to a summit portion of a cylinder block provided between the respective cylinder heads.

6. The fuel supply system as set forth in claim 5, wherein the water jacket assembly is disposed with a thermostat on the central portion rigidly connected to the summit portion of the cylinder block via a cooling water passage for leading a cooling water inside the cylinder block to the thermostat.

7. The fuel supply system as set forth in claim 1, wherein a fuel pressure delivered to the respective fuel injection valves is set at a pressure value enabling the fuel to be injected into combustion chambers of the V-type engine from the fuel injection valves during compression stroke of the V-type engine.

8. A fuel supply system for a V-type engine comprising:

a fuel pump;

a fuel injection valve provided for each cylinder; and a fuel supply conduit supplying fuel delivered under pressure by the fuel pump to the each fuel injection valve, the fuel supply conduit including an intermediate portion thereof arranged to straddle between cylinder heads in both banks of the V-type engine, the intermediate portion being rigidly connected to a water jacket assembly arranged so as to rigidly bridge between the cylinder heads in the both banks.

9. A V-type engine comprising a fuel supply system, wherein the fuel supply system comprises:

a fuel pump;

a fuel injection valve provided for each cylinder; and a fuel supply conduit supplying fuel delivered under pressure by the fuel pump to the each fuel injection valve, the fuel supply conduit including a fuel supply conduit portion thereof arranged to straddle between cylinder blocks in both banks of the V-type engine, the fuel supply conduit portion being rigidly connected to a water jacket assembly arranged to bridge between the cylinder heads in the both banks.

* * * * *